United States Patent [19]

Zarbos

[11] 4,297,746

[45] Nov. 3, 1981

[54] TORSO GARMENT INCORPORATING REMOVABLE HAND COVERINGS

[76] Inventor: Catherine Zarbos, 845 Brunswick Rd., Baltimore, Md. 21221

[21] Appl. No.: 163,590

[22] Filed: Jun. 27, 1980

[51] Int. Cl.[3] ..... A41D 1/02

[52] U.S. Cl. ..... 2/108; 2/158

[58] Field of Search ..... 2/108, 158, 70

[56] References Cited

U.S. PATENT DOCUMENTS

| | | | |
|---|---|---|---|
| 1,285,915 | 11/1918 | Bradley et al. | 2/158 |
| 1,296,966 | 3/1919 | Kufman | 2/158 |
| 1,423,546 | 7/1922 | Speer | 2/DIG. 2 |
| 2,069,643 | 2/1937 | Burke | 2/158 |

FOREIGN PATENT DOCUMENTS

| | | | |
|---|---|---|---|
| 1253 | of 1907 | United Kingdom | 2/70 |

*Primary Examiner*—Doris L. Troutman

*Attorney, Agent, or Firm*—Samuel Louis Sachs

[57] ABSTRACT

A sweater type garment for covering the upper torso, arms, and hands of a wearer which includes a body portion, arm portions, and a pair of hand covering portions integrally formed with the arm covering portions to form a total upper torso enclosure. Means are provided so that the hand covering portions can be removed from the hands of the user while the garment is disposed on the wearer to free the wearer's hands for use. The unused hand covering portions can then be inserted into the arm portions for storage until the user decides to wear them again.

7 Claims, 8 Drawing Figures

TORSO GARMENT INCORPORATING REMOVABLE HAND COVERINGS

BACKGROUND AND/OR ENVIRONMENT OF THE INVENTION

1. Field of the Invention

The present invention relates to torso garments, and more particularly, to torso garments which incorporate gloves or the like therein.

2. Description of the Contemporary and/or Prior Art

Many activities such as skiing, hiking, and outdoor work require torso as well as hand protection from the elements. The customary manner of providing such protection is for the user to wear a torso garment and a pair of gloves. This may not be satisfactory for several reasons including the possible entry of air between the gloves and the torso garment. In addition, the possibility of loosing a glove exists if it is removed as necessitated by a desire of the user to use bear hands for some task. Glove loss can be prevented by various methods such as clipping the gloves to the torso garment or by providing a clip on the gloves to secure them to something else. However, this is burdensome, cumbersome, and may cause damage to the garment.

For various reasons, gloves which extend all the way up the arms of the wearer are taught by the prior art. For instance, U.S. Pat. No. 4,016,027 issued to J. Kintanar on Apr. 5, 1977 teaches cosmetic gloves which extend up the arm of the wearer and are joined together about the shoulders of the wearer. These gloves are provided for cosmetic purposes.

U.S. Pat. No. De. 241,185 issued to J. V. Schlechter on Aug. 31, 1976 shows a cosmetic type fishnet garment which is provided for ornamental purposes wherein full length arms and gloves are provided. As in Kintanar, removal of the entire garment is necessary if the user is to have free unadorned hand use.

Similarly, U.S. Pat. No. 1,285,917 issued to C. R. Bradley et al on Nov. 26, 1918 discloses a hand protective garment which extends upwardly around the arms and joins about the neck of the wearer. This garment does not provide total covering for the arms or torso of the wearer and is really designed to cover the hands and outer portions of the arms and shoulders of the wearer. It does not incorporate a torso garment and does not permit means for ready removal of just the hands of the wearer from the garment.

U.S. Pat. No. 3,769,634 issued to N. Florens, Jr. on Nov. 6, 1973; U.S. Pat. No. 2,549,660 issued to H. A. Buhl et al on Apr. 17, 1951; and U.S. Pat. No. 2,069,643 issued to W. Burke on Feb. 2, 1937 each teach the use of a slide fastener on a glove to facilitate positioning of the glove on the wearer and removal therefrom. Attachment of these gloves to a garment is not shown or suggested.

The convenience of permitting a user to extend a bare hand or a portion thereof through a portion of a glove without total removal of the glove has been recognized in many glove patents including: U.S. Pat. No. 480,852 issued to F. J. Kahn on Aug. 16, 1892; U.S. Pat. No. 1,283,548 issued to R. E. H. O'Reilly on Nov. 5, 1918; U.S. Pat. No. 1,400,655 issued to O. H. Bohnert on Dec. 20, 1921; U.S. Pat. No. 2,274,335 issued to B. Kennedy on Feb. 24, 1942; U.S. Pat. No. 2,323,136 issued to J. M. Johanson on June 29, 1943; and U.S. Pat. No. 3,403,408 issued to B. Helfer on Oct. 1, 1968. None of these references show or suggest the incorporation of a glove in the arm of a garment.

U.S. Pat. No. 1,328,545 issued to D. C. O'Shea on Jan. 20, 1920 shows a sweater which has a lengthened sleeve to partially cover the back of the hand and a small portion of the palm of the wearer. A glove like enclosure is not shown or suggested.

U.S. Pat. No. 2,675,554 issued to P. L. Gertz on Apr. 20, 1954 discloses a children's garment wherein the sleeves thereof terminate in mittens which have an opening at the fingertips so that the hand of the child can be pushed out through the opening. Because of the opening next to the fingertips of the user, accidental exposure of the fingers when other than child-like pursuits are followed is quite likely. In addition, in order to extend the hand through the fingertip opening, the mitten is thrust backward and the sleeve must be bunched up around the arm of the user. This is certainly cumbersome and most likely uncomfortable. In addition, the elastic opening must be very tight to avoid accidental extension of the fingers therethrough and as such, will be extremely tight around the wrist of the wearer during use.

U.S. Pat. No. 4,122,553 teaches a combination jacket/vest garment wherein the sleeves of the garment can be retracted so that it may be worn as a vest. Provision for the incorporation of gloves to form a garment that covers the hands, arms, and torso of the user is not shown or suggested.

The present invention overcomes the previously discussed shortcomings of the prior art and provides a garment which entirely encapsulates the hands, arms, and upper torso of the user and which also permits free unincumbered use of the hands of the wearer as desired. When the hand covering portions of the garment of the present invention are not employed, they can be stored unobtrusively so that the garment has a smart looking and attractive appearance.

SUMMARY OF THE INVENTION

Therefore, a primary object of the present invention is to provide a garment for entirely covering and encapsulating the upper torso, arms, and hands of a wearer.

A further object of the present invention is to provide a garment which covers the upper torso, arms, and hands of the wearer wherein the hands of the wearer can be uncovered for unincumbered use as desired by the wearer.

A still further object of the present invention is to provide a garment which is ideally suited for manufacture as a sweater type garment.

Still another object of the present invention is to provide a garment which covers the arms and hands of the wearer wherein when the hand of the wearer is extended for uncovered use, the portion previously covering the hand may be stored so that the garment has the appearance of a conventional type sleeve.

Still another further object of the present invention is to provide a garment as previously described wherein a reinforced wristband is provided that provides aesthetic enhancement when the hand covering portion thereof is employed and serves as a cuff when the hand covering portion thereof is tucked inside the arm or sleeve of the garment.

Another further object of the present invention is to provide a garment as previously described, the essential features of which may be incorporated in various types and styles of upper torso garments.

Another still further object of the present invention is to provide a garment as previously described which is simple in design, relatively inexpensive to manufacture, easy to use and wear, and comfortable as well as stylish.

These objects, as well as further objects and advantaged of the present invention, will become readily apparent after reading the ensuing description of the nonlimiting illustrative embodiments and examining the accompanying drawing.

A garment for covering the upper torso, arms, and hands of a wearer, according to the principles of the present invention, comprises a body portion dimensioned to cover the torso of the wearer, the torso portion having a pair of arm apertures disposed through the sides thereof through which the arms of the wearer pass when the body portion is disposed on the torso of the wearer, a pair of arm portions dimensioned to cover the arms of the wearer, each of the arm portions being affixed on one end thereof to the body portion to form a sleeve, the interior of the sleeves communicating with the interior of the body portion, a pair of hand covering portions dimensioned to cover the hands of the wearer, one of the hand covering portions being affixed to the other ends of each of the arm portions, the interior of each of the hand covering portions communicating with the corresponding arm portion, the arm portions and the hand covering portions thereby forming a pair of integral arm-hand covering portions, each of the integral arm-hand covering portions have disposed therein a slit dimensioned to pass the adjacent hand of the wearer therethrough, and a pair of selective closure means for closing and opening the slits as desired by the wearer.

BRIEF DESCRIPTION OF THE DRAWING

In order that the present invention may be more fully understood, it will now be described, by way of example, with reference to the accompanying drawing in which.

DESCRIPTION OF THE PREFERRED EMBODIMENTS

Figure 1:
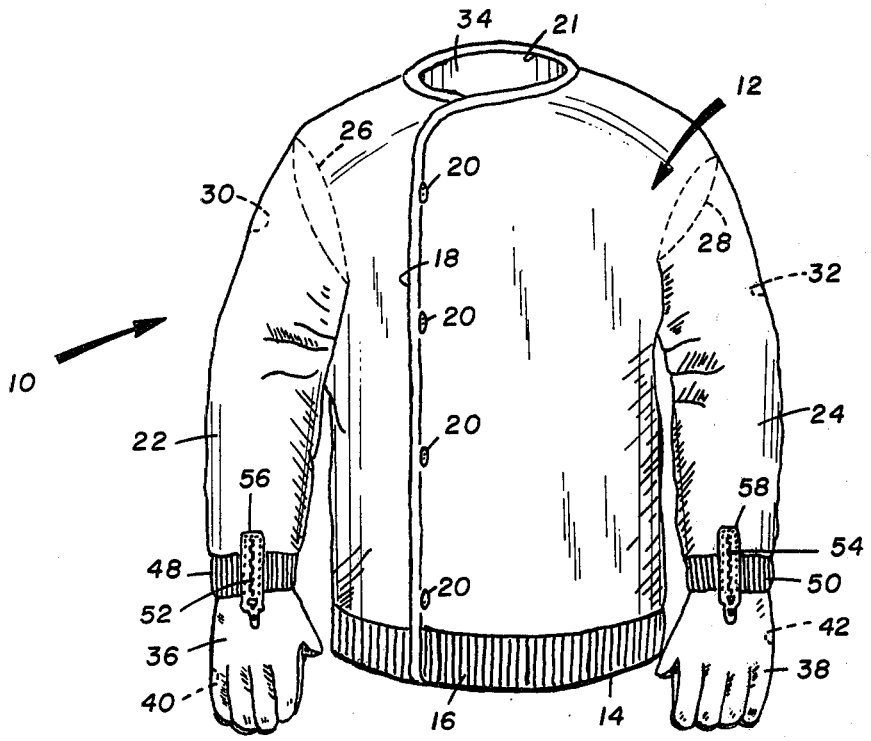
FIG. 1 is a pictorial front view of a garment incorporating the principles of the present invention.
Figure 2:
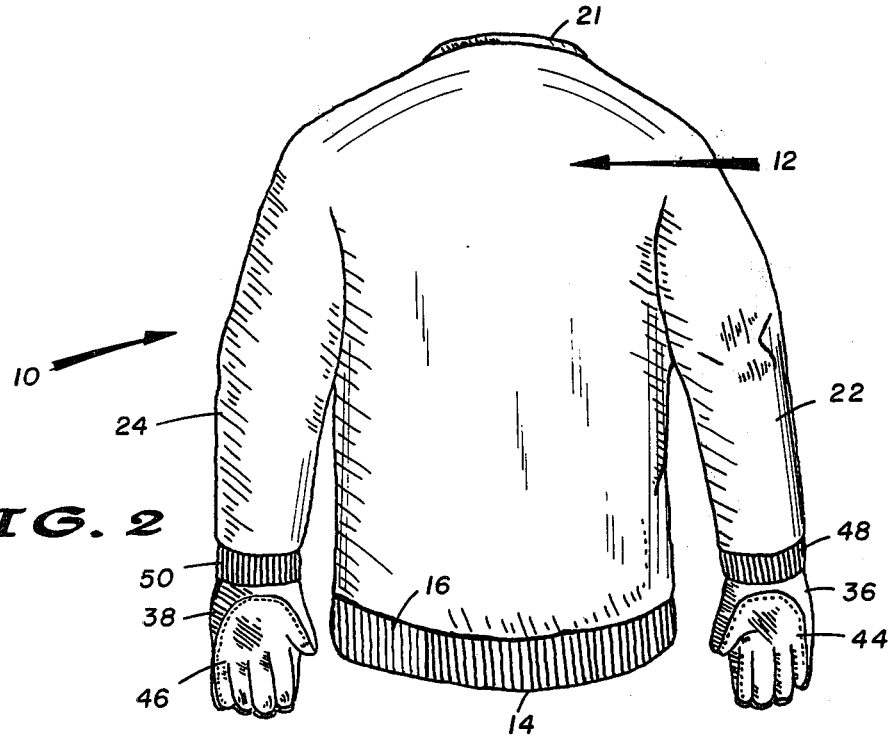
FIG. 2 is a rear view of the garment of FIG. 1.

Referring now to the figures, and more particularly to FIGS. 1 and 2 thereof, there is illustrated therein a sweater type garment 10 which incorporates the principles of the present invention therein. The sweater type garment 10 includes a body portion 12 which is dimensioned to cover the upper torso of the wearer. A torso opening 14 is provided adjacent to the base of the body portion 12 and is trimmed with a suitable trim 16 which can have elastic properties to cause the torso opening 14 to be held tightly against the body of the wearer. The body portion 12 includes a frontal opening 18, illustrated in the closed position, secured by a plurality of buttoms 20 affixed to the body portion 12 in a conventional manner. When the frontal opening 18 is closed, it forms a neck opening 21 to accommodate the neck of the wearer.

The sweater type garment 10 includes a pair of arm portions 22 and 24 dimensioned to cover the arms of the wearer. The arm portions 22 and 24 are affixed to the body portion 12 about arm apertures 26 and 28 provided in the body portion 12 so that the interiors 30 and 32, respectively, of the arms 22 and 24 are in communication directly with the interior 34 of the body portion 12. The arm portions 22 and 24 can be affixed to the body portion 12 at the arm apertures 26 and 28 by a seaming process or the arm portions 22 and 24 can be integrally formed with the body portion 12. Affixed to the lower ends of each of the arm portions 22 and 24, respectively, are hand covering portions 36 and 38. The interiors 40 and 42, respectively, of the hand covering portions 36 and 38 communicate directly, respectively, with the interiors 30 and 32 of the arm portions 22 and 24. The arm portions 22 and 24 and the respective hand covering portions 36 and 38 thereby form integral arm-hand covering portions as illustrated. Therefore, the garment 10 covers the entire hands, arms, and upper torso of the wearer in an integral package only open at the torso opening 14 which is snug against the torso of the wearer and at the neck opening 21.

The hand covering portions 36 and 38 are illustrated with separate finger compartments as in a glove, but it is to be understood that these portions could also be formed in a mitten like configuration with one compartment for the thumbs of the wearer and a common compartment for the balance of the fingers of the wearer. The garment 10 preferably incorporates reinforcing pads 44 and 46 which are fixedly secured to the palm area and the inner side of the hand covering portions 36 and 38. The reinforcing pads 44 and 46 can be fabricated from leather or a suitable vinyl substitute as desired by the manufacturer.

Annular sections 48 and 50, respectively, of the arm-hand covering portions of the garment 10 are reinforced by a material which serves inter alia as decorative trim and which may be stretchable. Slits 52 and 54 are disposed, respectively, in the arm-hand covering portions formed by the arm portion 22 and the hand covering portion 36, and the arm covering portion 24 and the hand covering portion 38 with the slits extending through the annular sections 48 and 50. The slits 52 and 54 are dimensioned so that they can pass the hand of the wearer therethrough as hereinafter described. The slits 52 and 54 are preferably disposed in the garment 10 in the portion thereof which resides adjacent to the back of the wrist of the wearer when the wearer is wearing the garment. This position is illustrated in FIG. 1.

The slits 52 and 54 are oriented so that they are longitudinally disposed relative to the longitudinal axis of the adjacent arm portions 22 and 24. The slits 52 and 54 are selectively openable and closeable by a pair of slide fasteners 56 and 58, respectively, mounted to the garment 10 adjacent thereto. The slide fasteners 56 and 58, as illustrated, are zippers, but other suitable slide fasteners as well as nonslide fasteners can be employed as long as the essential function of being capable of opening and closing slits 52 and 54, as desired by the user, are served. The purpose of the slide fasteners 56 and 58 will be described in conjunction with FIGS. 5 through 8 and comprise an essential feature of the present invention. The slide fasteners can be backed with a conventional closure flap for insulation purposes.

Figure 3:
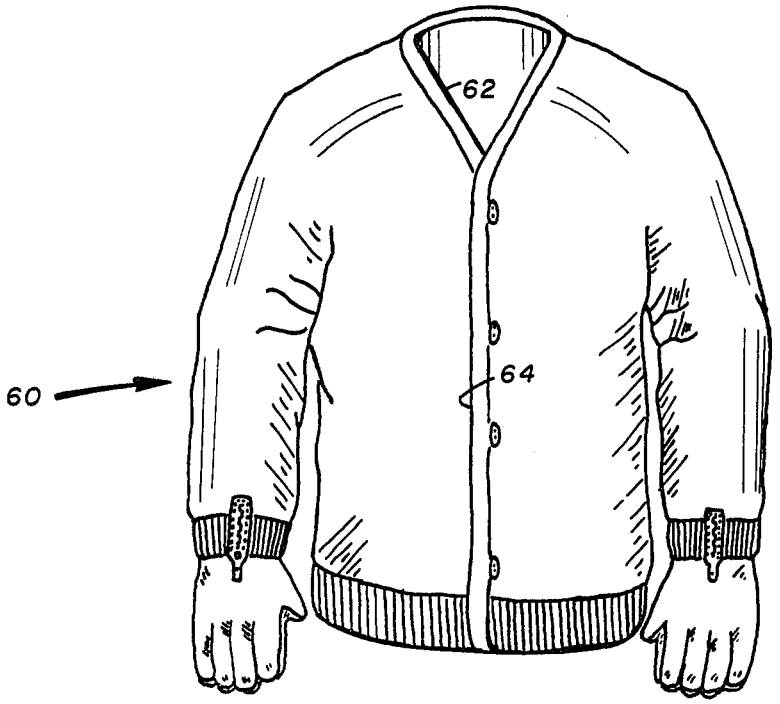
FIG. 3 is a front view of another style of garment incorporating the principles of the present invention therein.
Figure 4:
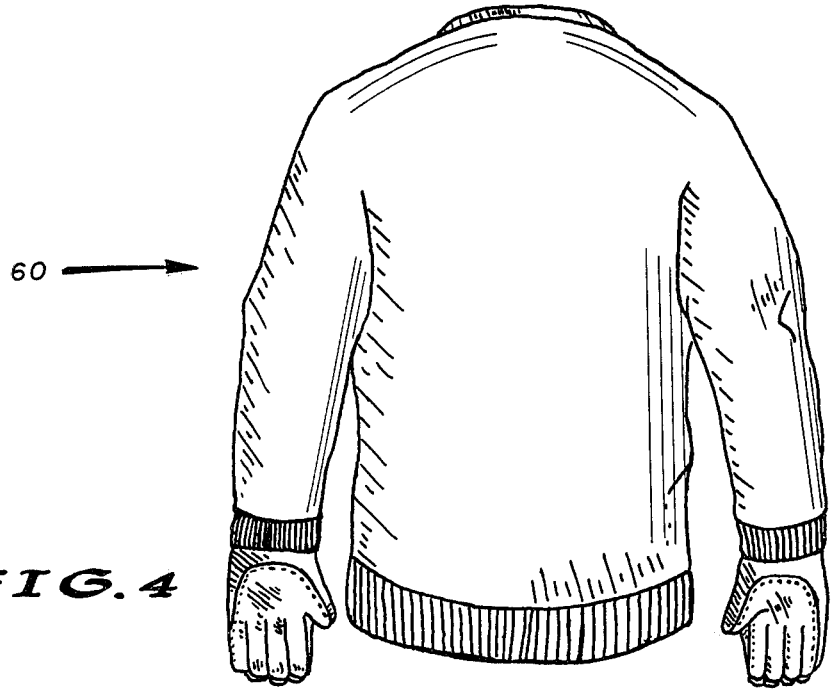
FIG. 4 is a rear view of the garment illustrated in FIG. 3.

Referring to FIGS. 3 and 4, there is illustrated therein a sweater type garment 60 which incorporates the features of the present invention. The sweater type garment 60 is essentially similar to the sweater type garment 10 insofar as the features thereof are concerned, but these figures illustrate the features of this invention incorporated in an alternately styled sweater. Specifically, the sweater is provided with a V-neck 62 and a centrally located frontal opening 64 in contrast to the round neck opening 21 and offset frontal opening 18 of the garment 10 illustrated in FIGS. 1 and 2. It should be apparent that the integral arm-hand covering portions including slits and slide fasteners shown in FIGS. 1, 2, 3, and 4 can be incorporated in other variously configured or styled upper torso garments. Garments 10 and 60 are both sweater type garments as this is the preferential construction of the present invention. These sweater type garments would be formed using conventional knitting wherein a single strand or bundle of strands of material are interlocked to form the fabric. Alternately, other sweater type fabrication techniques such as crocheting or machine manipulations can be employed. Suitable fabrics might include wool or any of the synthetic substitutes therefor. In addition, the garment could be manufactured of other than sweater type material without departing from the scope of the present invention.

Figure 5:
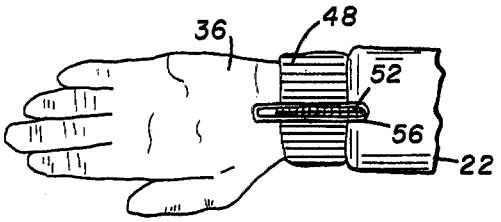
FIG. 5 is a fragmentary view of a hand and arm portion of the present invention in place on a wearer.
Figure 6:
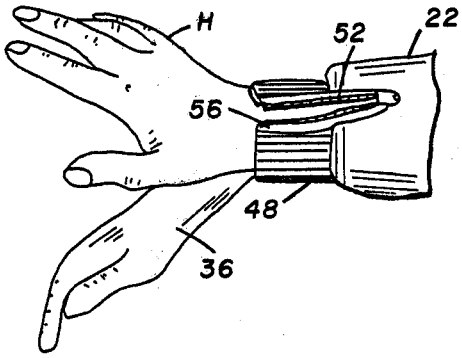
FIG. 6 is a side view of a hand of a wearer extending through an opening for unincumbered use.

FIGS. 5 through 8 illustrate a fragmentary view of the hand covering portion 36 and the arm covering portion 22 for purposes of showing the manner in which the garment 10 can entirely cover a hand H of the wearer or can expose the same for free unincumbered use. In FIG. 5, the hand covering portion 36 is shown entirely covering the hand H of the wearer and the slide fastener 56 is illustrated in a closed position thereby closing the slit 52. When the garment 10 is employed in this manner, the entire hand H of the user is covered and is kept warm. If free unincumbered use of the wearer's hand is desired, the slide fastener 56 is opened and the wearer's hand H is passed through the slit 52 after the digits of the user's hand are removed from the appropriate compartments in the hand covering portion 36, as illustrated in FIG. 6. If the wearer's hand need only be exposed for a short time, for instance if a bare hand was needed to light a match or accomplish some other task, the hand covering portion 36 could be left to momentarily dangle as illustrated in FIG. 6 thereby permitting rapid reinsertion of the wearer's hand H into the hand covering portion 36.

Figure 7:
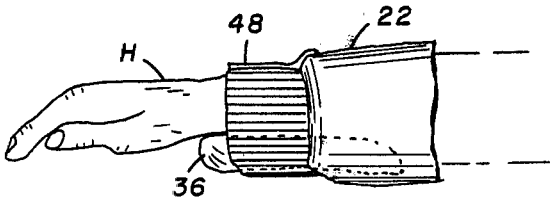
FIG. 7 is a side view of the hand of a wearer extending from the arm portion of the garment of FIGS. 5 and 6 wherein the hand portion is tucked partially within the sleeve.
Figure 8:
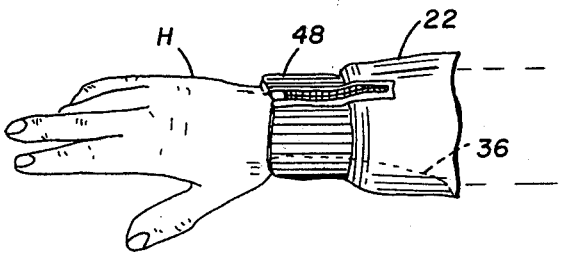
FIG. 8 is a fragmentary top view of the arm of the wearer wherein the hand portion of the garment is tucked entirely within the sleeve so that the arm of the garment has the appearance of that of a conventional garment.

However, if the wearer's hand is to be used for a relatively long period of time or if glove protection is not desired, the present invention provides means for storing the hand covering portion 36 out of sight both for purposes of noninterference and for aesthetic enhancement. As illustrated in FIG. 7, the hand covering portion 36 can be tucked inside the arm portion 22 for storage with the final appearance of the arm portion 22 being as illustrated in FIG. 8. Such a use permits the arm portion 22 to look essentially like that of a garment not incorporating hand covering portions with the reinforced annular section 48 serving as a cuff. Because of the reinforcing of the annular section 48, reduction of wear at a critical point when the garment is worn with the hand covering portions in a stored position is accomplished. In addition, a pleasing conventional cuff appearance is provided.

Although the immediately preceeding description relates to arm portion 22 and hand covering portion 36, it is likewise applicable to arm portion 24 and hand covering portion 38 which are essentially similar.

It will be understood that various changes in the details, materials, arrangements of parts and operational conditions which have been herein described and illustrated in order to explain the nature of the invention may be made by those skilled in the art within the principles and scope of the present invention.

Therefore, a primary advantage of the present invention is the provision of a garment for entirely covering and encapsulating the upper torso, arms, and hands of the wearer.

A further advantage of the present invention is the provision of a garment which covers the upper torso, arms, and hands of the wearer wherein the hands of the wearer can be uncovered for unincumbered use as desired by the wearer.

A still further advantage of the present invention is the provision of a garment which is ideally suited for manufacture as a sweater type garment.

Still another advantage of the present invention is the provision of a garment which covers the arms and hands of the wearer wherein when the hand of the wearer is extended for uncovered use, the portion previously covering the hand may be stored so that the garment has the appearance of a conventional type sleeve.

Still another further advantage of the present invention is the provision of a garment as previously described wherein a reinforced wristband is provided that provides aesthetic enhancement when the hand covering portion thereof is employed and serves a cuff when the hand covering portion thereof is tucked inside the arm or sleeve of the garment.

Another further advantage of the present invention is the provision of a garment as previously described, the essential features of which may be incorporated in various types and styles of upper torso garments.

Another still further advantage of the present invention is the provision of a garment as previously described which is simple in design, relatively inexpensive to manufacture, easy to use and wear, and comfortable as well as stylish.

Having thus set forth the nature of the invention, what is claimed is:

1. A garment for covering the upper torso, arms, and hands of a wearer comprising:

a body portion dimensioned to cover the torso of the wearer, said body portion having a pair of arm apertures disposed through the sides thereof through which the arms of the wearer pass when said body portion is disposed on said torso;

a pair of arm portions dimensioned to cover said arms of said wearer, each of said arm portions being affixed on one end thereof to said body portion about one of said arm apertures to form a sleeve, the interior of said sleeves communicating with the interior of said body portion;

a pair of hand covering portions dimensioned to cover the hands of said wearer, one of said hand covering portions being affixed to the other ends of each of said arm portions, the interior of each of said hand covering portions communicating with the corresponding arm portion, said arm portions and said hand covering portions thereby forming a pair of integral arm-hand covering portions;

each of said integral arm-hand covering portions having disposed therein a slit dimensioned to pass the adjacent hand of the wearer therethrough, each of said slits being disposed in the associated said arm-hand covering portions in the portion thereof which resides proximate to the back of the adjacent wrist of the wearer when wearing said garment, said slit in each of said integral arm-hand covering portions being longitudinally disposed relative to the longitudinal axis of the associated said arm portion, an annular section of each of said arm-hand covering portions being reinforced, said longitudinally disposed slit in each arm-hand covering portion extending through said corresponding annular reinforced section, each of said slits being dimensioned to permit tucking of said adjacent hand covering portion into said adjacent arm portion proximate to the underside of the wrist of the wearer when the hand of the wearer is extended through said slit, said annular reinforced portions thereby serving as a cuff for said arm portion; and a pair of selective closure means for closing and opening said slits as desired by the wearer.

2. A garment in accordance with claim 1, wherein each of said selective closure means comprises a slide fastener.

3. A garment in accordance with claim 2, wherein each of said slide fasteners comprises a zipper.

4. A garment in accordance with claim 1, wherein said hand covering portion is glove like.

5. A garment in accordance with claim 4, further comprising reinforcing means fixedly secured to the palm area and the inner side of the finger areas of said glove-like hand covering portions.

6. A garment in accordance with claim 1, further comprising a frontal opening and suitable closing means therefor disposed in said body portion.

7. A garment in accordance with claim 1, wherein said arm-hand covering portions are of knitted strand interlocked construction.

* * * * *